US009284505B2

(12) United States Patent
Sondjaja et al.

(10) Patent No.: US 9,284,505 B2
(45) Date of Patent: Mar. 15, 2016

(54) COMPOSITION TO IMPROVE OXIDATION STABILITY OF FUEL OILS

(75) Inventors: Ronny Sondjaja, Darmstadt (DE); Jane Benito, Singapore (SG); Gwen Teh, Selangor Darul Ehsan (MY); Frank-Olaf Mähling, Mannheim (DE)

(73) Assignee: Evonik Oil Additives GmbH, Darmstadt (DE)

( * ) Notice: Subject to any disclaimer, the term of this patent is extended or adjusted under 35 U.S.C. 154(b) by 58 days.

(21) Appl. No.: 14/007,589

(22) PCT Filed: Feb. 24, 2012

(86) PCT No.: PCT/EP2012/053116

§ 371 (c)(1),
(2), (4) Date: Oct. 10, 2013

(87) PCT Pub. No.: WO2012/130535

PCT Pub. Date: Oct. 4, 2012

(65) Prior Publication Data

US 2014/0033605 A1 Feb. 6, 2014

(30) Foreign Application Priority Data

Mar. 25, 2011 (EP) ..... 11159725

(51) Int. Cl.

| | |
|---|---|
| ***C10L 1/185*** | (2006.01) |
| ***C10L 1/14*** | (2006.01) |
| ***C10L 1/16*** | (2006.01) |
| *C10L 1/183* | (2006.01) |
| *C10L 1/19* | (2006.01) |
| *C10L 1/196* | (2006.01) |
| *C10L 1/197* | (2006.01) |

(52) U.S. Cl.

CPC ..... *C10L 1/1852* (2013.01); *C10L 1/143* (2013.01); *C10L 1/1641* (2013.01); *C10L 1/1832* (2013.01); *C10L 1/1835* (2013.01); *C10L 1/183* (2013.01); *C10L 1/19* (2013.01); *C10L 1/1963* (2013.01); *C10L 1/1973* (2013.01)

(58) Field of Classification Search

CPC ..... C10L 2200/0476; C10L 2230/081; C10L 2230/14

USPC ..... 44/388, 389, 393, 442, 450

See application file for complete search history.

(56) References Cited

U.S. PATENT DOCUMENTS

| | | | | |
|---|---|---|---|---|
| 4,932,980 | A | 6/1990 | Mueller et al. | |
| 7,964,002 | B2 * | 6/2011 | DeBlase et al. | 44/412 |
| 8,075,804 | B2 * | 12/2011 | Carter et al. | 252/404 |
| 8,328,883 | B2 * | 12/2012 | Tiedemann et al. | 44/300 |
| 8,657,890 | B2 * | 2/2014 | Ng et al. | 44/308 |
| 8,663,344 | B2 * | 3/2014 | Schneller et al. | 44/308 |
| 8,721,744 | B2 * | 5/2014 | Maehling et al. | 44/393 |
| 2004/0139649 | A1 * | 7/2004 | Ingendoh et al. | 44/450 |
| 2004/0244278 | A1 * | 12/2004 | Siggelkow et al. | 44/389 |
| 2006/0137242 | A1 | 6/2006 | Siggelkow et al. | |
| 2006/0219979 | A1 * | 10/2006 | Asbahr et al. | 252/399 |
| 2007/0157509 | A1 * | 7/2007 | Siggelkow et al. | 44/393 |
| 2007/0161755 | A1 * | 7/2007 | Siggelkow et al. | 525/242 |
| 2010/0293842 | A1 | 11/2010 | Kasel et al. | |
| 2011/0192076 | A1 * | 8/2011 | Hess et al. | 44/388 |
| 2012/0102825 | A1 * | 5/2012 | Chevrot et al. | 44/307 |
| 2012/0174474 | A1 | 7/2012 | Sondjaja et al. | |

FOREIGN PATENT DOCUMENTS

| | | | |
|---|---|---|---|
| CN | 101082004 | | 12/2007 |
| EP | 1391498 | A1 * | 2/2004 |

OTHER PUBLICATIONS

International Search Report Issued Apr. 19, 2012 in PCT/EP12/053116 filed Feb. 24, 2012.

Singapore Search Report and Written Opinion issued Oct. 31, 2014 in Patent Application No. 2013068754.

U.S. Appl. No. 14/427,812, filed Mar. 12, 2015, Gokhale, et al.

* cited by examiner

*Primary Examiner* — Ellen McAvoy

(74) *Attorney, Agent, or Firm* — Oblon, McClelland, Maier & Neustadt, L.L.P.

(57) ABSTRACT

The present invention describes a composition comprising at least one antioxidant and at least one ethylene vinyl acetate copolymer comprising units being derived from at least one alkyl (meth)acrylate having 1 to 30 carbon atoms in the alkyl residue. The composition is useful as cold flow improver and oxidation stabilizer in fossil fuel oil and or biodiesel fuel oil.

15 Claims, No Drawings

COMPOSITION TO IMPROVE OXIDATION STABILITY OF FUEL OILS

The present application relates to a composition to improve oxidation stability of fuel oils.

Fuels are nowadays typically obtained from fossil sources. However, these resources are limited, so that replacements are being sought. Therefore, interest is rising in renewable raw materials which can be used to produce fuels. A very interesting replacement is in particular biodiesel fuel.

The term biodiesel is in many cases understood to mean a mixture of fatty acid esters, usually fatty acid methyl esters (FAMEs), with chain lengths of the fatty acid fraction of 14 to 24 carbon atoms with 0 to 3 double bonds. The higher the carbon number and the fewer double bonds are present, the higher is the melting point of the FAME. Typical raw materials are vegetable oils (i.e. glycerides) such as rapeseed oils, sunflower oils, soya oils, palm oils, coconut oils and, in isolated cases, even used vegetable oils. These are converted to the corresponding FAMEs by transesterification, usually with methanol under basic catalysis.

The FAME content also affects the cold flow properties of the feedstock. The lower the carbon number and the lower the degree of saturation is in the fatty acid chains, the better is the cold flow property of the feedstock. The common methods to evaluate the cold flow quality are: pour point (PP) test as mentioned in ASTM D97, filterability limit via cold filter plugging point (CFPP) test measured to DIN EN 116 or ASTM D6371, and cloud point (CP) test as described in ASTM D2500.

Currently rapeseed oil methyl ester (RME) is the preferred stock for biodiesel production in Europe as rapeseed produces more oil per unit of land area compared to other oil sources. However with the high price level of RME, mixtures of RME with other feedstock, such as soybean (SME) or palm methyl ester (PME), have been exploited as well. Soybean is the preferred feedstock in America and palm oil is preferred in Asia. In addition to the utilization of 100% biodiesel, mixtures of fossil diesel, i.e. the middle distillate of crude oil distillation, and biodiesel are also of interest owing to the improved low-temperature properties and better combustion characteristics.

In view of the declining ecological quality and decreasing world crude oil reserves, the use of pure biodiesel (B100) has been an important target in many countries. However, many issues, ranging from different combustion characteristics to corrosion of seal materials, have been reported as hindrances to the use of biodiesel as a replacement for fossil diesel. Furthermore, the oxidation stability of these biodiesel may cause serious problems. Due to the oxidative degradation of the fatty acid esters that may be accelerated by UV light, heat, trace metal presence, and other factors, the fuel often becomes "rancid" or unstable, leading ultimately to sludge and gum formation, thus destroying its intended usage as a fuel source. This degradation results in a marked increase in the amount of filterable solids present in the fuel thereby clogging fuel filters and otherwise leading to plugging problems in fuel lines and injectors associated with the engine.

A number of natural and synthetic chemicals have been reported to improve the biodiesel oxidation stability. Patent application US 2004/0139649 (Bayer) describes the use of 2,4-di-t-butylhydroxytoluene (BHT) to increase storage stability of biodiesel as single component antioxidant. Patent application US 2006/0219979 (Degussa AG), on the other hand, discloses the use of phenolic compounds as antioxidant in the mixture form. Synergistic between phenolic compounds was described in WO2009/108747A1 (Wayne State University). Furthermore, US 2009/094887 describes a method for improving the stability of biodiesel fuel by using an amount effective for the purpose of (I) a hindered phenol and (II) a Mannich reaction product.

Another major obstacle is the flow behavior of biodiesel at low temperature. For example, RME has a Cold Filter Plugging Point (CFPP) in the range of −13 to −16° C., which cannot be directly used to meet the winter diesel requirement in Central Europe (i.e. CFPP value of −20° C. or below). The issue is more challenging when feedstocks containing higher amount of saturated carbon chains, such as SME, PME or tallow methyl ester (TME), are used either as pure B100 or mixture with RME. Therefore, prior art teaches the use of additives to improve the cold flow properties.

Polyalkyl(meth)acrylates PA(M)A with the presence of M(M)A (e.g. Rohm & Haas Co's patent: U.S. Pat. No. 5,312,884) or without the presence of M(M)A (e.g. Shell Oil's patent: U.S. Pat. No. 3,869,396) as flow improvers for mineral oil have been widely established. The use of hydroxyfunctional-containing PA(M)A as biodiesel cold flow improver (CFI) can also be found in the literature (e.g. RohMax Additives GmbH patent: EP 103260). Also US 2009/0064568 discloses a composition of biodiesel fuel, particularly PME, containing PA(M)A as flow improver.

WO 2009/047786 (Dai-ichi Karkaria Ltd) discloses esterification and polymerization process to synthesize PA(M)A copolymer from alcohol blend containing 1-6% hydrocarbon. The copolymer is used as pour point depressant for fuel oil and biodiesel. WO 2008/154558 (Arkema Inc) discloses the invention of alkyl (meth)acrylic block copolymers or homopolymers, synthesized by a controlled free radical process and the use as cold flow modifiers in biofuels.

Another ingredient widely used as cold flow improver (CFI) is ethylene vinyl acetate (EVA) copolymer as disclosed in U.S. Pat. No. 5,743,923 (Exxon Chemicals), U.S. Pat. No. 7,276,264 (Clariant GmbH). U.S. Pat. No. 6,565,616 (Clariant GmbH) discloses an additive for improving the cold flow properties containing blend of EVA and copolymers containing maleic anhydride or alkyl acrylates. EP 406684 (Röhm GmbH) discloses a flow improver additive containing mixture of EVA copolymer and PA(M)A.

U.S. Pat. No. 4,932,980 and EP 406684 (both of Röhm GmbH) disclose flow improvers based on a graft polymer consisting of 80-20% EVA copolymer as the backbone and 20-80% alkyl (meth)acrylate as the grafting monomer. US 2007/0161755 (Clariant Ltd) focuses on the use of EVA-graft-(meth)acrylate as flow improvers for mineral and biofuels. The patent (application) also mentions the addition of co-additives.

Based on the statements mentioned above, biodiesel fuels should show acceptable cold flow property and oxidation stability. However, combining a cold flow improver with an antioxidant might impact the oxidation stability and cold flow properties in a negative direction.

Based on the objectives mentioned above, a further improvement of the oxidation stability and the cold flow properties is an enduring challenge. Preferably, the combination of a cold flow improver and an antioxidant should provide a synergistic improvement. At least, no essential decrease in any of these properties should be achieved.

Some of the additives mentioned above improve the cold flow properties at a very specific treat rate in the fuel oil. However, below or above that very specific treat rate, the cold flow properties are significantly worse. The commercially available fuel oils are standardized in some aspects such as flow properties, combustion behavior and the origin of the fuel oil. However, biodiesel fuel oils are not strictly standardized regarding the composition of the fatty acid esters. Furthermore, recent engines may use fossil fuel oils and biodiesel fuel oils in different amounts. Based on the prizes and availability of the fuel oils, the customers usually use fuel oils from different sources comprising diverse cold flow improvers. Therefore, a dilution of the fuel oil additive cannot be avoided such that the efficiency of the additive is lowered. Therefore, although these additives show an acceptable efficiency at very specific contents the overall efficiency should be improved.

Furthermore, some of the additives may have an acceptable efficiency regarding a very special type of fuel oil such as rapeseed oil methyl ester (RME). However, in other fuel oils such as mineral diesel fuel or palm oil methyl ester (PME) these additives show a low performance. As mentioned above, mixing of fuel oils by the customers must be considered. Therefore, the additives should be useful in very different fuel oil compositions.

In addition thereto, an additive composition containing cold flow improvers (CFI) and antioxidants in stable homogeneous solution form and this invented additive should give both cold flow and oxidation stability improvements without showing any antagonistic effects should be provided.

Furthermore, the additives should be producible in a simple and inexpensive manner, and especially commercially available components should be used. In this context, they should be producible on the industrial scale without new plants or plants of complicated construction being required for this purpose.

These objects and also further objects which are not stated explicitly but are immediately derivable or discernible from the connections discussed herein by way of introduction are achieved by compositions having all features of claim 1. Appropriate modifications to the inventive compositions are protected in the claims referring back to claim 1.

The present invention accordingly provides a composition comprising at least one antioxidant and at least one ethylene vinyl acetate copolymer comprising units being derived from at least one alkyl (meth)acrylate having 1 to 30 carbon atoms in the alkyl residue.

The present compositions provide high oxidation stability and a high efficiency as cold flow improver.

At the same time, the inventive polymers allow a series of further advantages to be achieved. These include:

The composition of the present invention provides outstanding oxidation stability to a wide range of biodiesel fuel compositions.

The compositions of the present invention improve the cold flow properties of very different fuel oil compositions. The present additive composition provides outstanding efficiency as cold flow improvers. Furthermore, these improvements can be achieved by applying low or high treat rates of the composition to the fuel oil. The compositions of the present invention can be prepared in a particularly easy and simple manner. It is possible to use customary industrial scale plants.

According to a preferred aspect of the present invention an additive composition containing cold flow improvers (CFI) and antioxidants in stable miscible solution form and this invented additive can give both cold flow and oxidation stability performances without showing any antagonistic effects is provided.

The inventive composition comprises at least one antioxidant. The antioxidant used in the present invention is in the general class known as free radical inhibitors and/or antioxidants. More specifically the antioxidants used are well known as disclosed in the documents mentioned above.

Preferred antioxidants useful for the present invention are disclosed in US 2004/0139649, US 2006/0219979, US 2009/094887A1 and WO 2009/108747 A1. The documents US 2004/0139649 filed with the United States Patent and Trademark Office Nov. 7, 2003 under the application Ser. No. 10/703,263; US 2006/0219979 filed with the United States Patent and Trademark Office Apr. 4, 2006 under the application Ser. No. 11/396,472; US 2009/094887A1 filed with the United States Patent and Trademark Office Oct. 16, 2007 under the application Ser. No. 11/974,799 and WO 2009/108747 A1 filed with the United States Patent and Trademark Office Feb. 26, 2009 under the Application number PCT/US2009/035226 are enclosed herein by reference.

The antioxidants are generally commercially available. For more details it is herein referred to known prior art, in particular to Römpp-Lexikon Chemie; Editor: J. Falbe, M. Regitz; Stuttgart, New York; 10. version (1996); keyword "antioxidants" and the at this site cited literature references.

Antioxidants include e.g. aromatic compounds and/or nitrogen containing compounds.

Organic nitrogen compounds being useful as antioxidant are known in themselves. Besides one or more nitrogen atoms, they contain alkyl, cycloalkyl or aryl groups, and the nitrogen atom may also be a member of a cyclic group.

Preferably, nitrogen containing compounds include amine-containing antioxidant components. Examples include naphthylamine derivative, diphenylamine derivative, p-phenylene diamine derivative, and quinoline derivative as mentioned e.g. in CN 101353601 A, nitro-aromatics, e.g. nitro benzene, di-nitrobenzene, nitro-toluene, nitro-napthalene, and di-nitro-napthalene and alkyl nitro benzenes and poly aromatics as mentioned e.g. in WO 2008/056203 A2 and aliphatic amine as described e.g. in WO 2009/016400 A1.

The documents CN 101353601 A filed with the Chinese Patent Office Jul. 5, 2007 under the Application number 200710052650; WO 2008/056203 A2 filed with the International Bureau Jul. 11, 2006 under the Application number PCT/IB2006/004289; WO 2009/016400 A1 filed with the United Kingdom Patent and Trademark Office Jul. 25, 2008 under the Application number PCT/GB2008/050626 are enclosed herein by reference.

Preferred antioxidants comprise amines, such as thiodiphenylamine and phenothiazine; and/or p-phenylene diamines, such as N,N'-diphenyl-p-phenylene diamine, N,N'-di-2-naphthyl-p-phenylene diamine, N,N'-di-p-tolyl-p-phenylene diamine, N-1,3-dimethylbutyl-N'-phenyl-p-phenylene diamine and N-1,4-dimethylpentyl-N'-phenyl-p-phenylene diamine.

In a very preferred embodiment of the invention, the antioxidant is an aromatic compound. These aromatic compounds comprise phenolic compounds; especially sterically hindered phenols, such as 2,4-di-t-butylhydroxytoluene (BHT), 2,4-dimethyl-6-tert-butylphenol or 2,6-ditert-butyl-4-methylphenol; tocopherol-compounds, preferably alpha-tocopherol; and/or hydroquinone ethers, such as hydroquinone monomethylether, 2-tert-Butyl-4-hydroxyanisole and 3-tert-butyl-4-hydroxyanisole.

Especially preferred phenolic compounds have 2 or more hydroxyl groups such as dihydroxybenzenes, preferably hydroquinone or derivatives thereof, such as alkyl hydroquinones, e.g. tert-butylhydroquinone (TBHQ), 2,6-di-tert-butylhydroquinone (DTBHQ), 2,5-di-tert-butylhydroquinone or pyrocatechol or alkyl pyrocatechols, e.g. di-tert-butylbrenzcatechine.

Furthermore, phenolic compounds having 3 or more hydroxyl groups are preferred. These compounds include e.g. propyl gallate and pyrogallol.

Regarding the antioxidants mentioned, phenolic compounds are specially preferred.

The antioxidants can be used individually or as a mixture. Surprising results could be achieved with mixtures comprising phenolic compounds having at least two hydroxyl groups such as hydroquinones, propyl gallate and pyrogallol; and phenolic compounds having exactly one hydroxyl groups such as hydroquinone ethers, sterically hindered phenols, such as 2,4-di-tert-butylhydroxytoluene (BHT), 2,4-dimethyl-6-tert-butylphenol or 2,6-di-tert-butyl-4-methylphenol; and/or tocopherol-compounds, preferably alpha-tocopherol. According to a very preferred embodiment, the mixture may preferably comprise phenolic compounds having at least three hydroxyl groups such as propyl gallate and pyrogallol; and phenolic compounds having exactly two hydroxyl groups such as hydroquinone or derivatives thereof.

If more than one antioxidant is used, the two antioxidants can preferably be at a weight ratio of in the range of about 20:1 to 1:20, especially more preferably 10:1 to 1:10, more preferably 5:1 to 1:5. Depending on the desired characteristics of the biodiesel, one skilled in the art, in view of the present disclosure, would be able to select appropriate concentrations and ratios of antioxidants.

In addition to at least one antioxidant, the present composition comprises at least one ethylene vinyl acetate copolymer comprising units being derived from at least one alkyl (meth) acrylate having 1 to 30 carbon atoms in the alkyl residue.

Polymers comprising units being derived from ethylene, vinyl acetate and at least one alkyl (meth)acrylate having 1 to 30 carbon atoms in the alkyl residue can be obtained by the polymerisation of corresponding monomer compositions. Ethylene and vinyl acetate are commercially available from a number of suppliers. Alkyl (meth)acrylates having 1 to 30 carbon atoms in the alkyl residue are described below and above and reference is made thereto.

These ethylene vinyl acetate copolymers may contain 1 to 60 weight %, particularly 5 to 40 weight %, preferably 10 to 20 weight % of units being derived from ethylene based on the total of the repeating units. Particular preference is given to ethylene vinyl acetate copolymers containing preferably 0.5 to 60 weight %, especially 2 to 36 weight % or 3 to 30 weight % and more preferably 5 to 10 weight % of vinyl acetate based on the total of the repeating units. Preferably, the amount of alkyl (meth)acrylates having 1 to 30 carbon atoms in the alkyl residue is in the range of from 10 weight % to 90 weight %, especially in the range of from 30 to 80 weight % and more preferably in the range of from 60 to 80 weight % based on the total of the repeating units.

According to a special embodiment of the present invention, the ethylene vinyl acetate copolymers preferably comprise from 30 to 90 weight %, more preferably from 60 to 80 weight % of units being derived from at least one alkyl (meth) acrylate having 7 to 15 carbon atoms in the alkyl residue.

Preferably, the molar ratio of ethylene to vinyl acetate of the ethylene vinyl acetate copolymer could be in the range of 100:1 to 1:2, more preferably in the range of 20:1 to 2:1, especially preferably 10:1 to 3:1. The molar ratio of alkyl (meth)acrylates having 1 to 30 carbon atoms in the alkyl residue to vinyl acetate of the ethylene vinyl acetate copolymer is preferably in the range of 50:1 to 1:2, more preferably in the range of 10:1 to 1:1, especially preferably 5:1 to 2:1. Particularly, the molar ratio of ethylene to alkyl (meth)acrylates having 1 to 30 carbon atoms in the alkyl residue of the ethylene vinyl acetate copolymer is preferably in the range of 10:1 to 1:20, more preferably in the range of 2:1 to 1:10, especially preferably 1:1 to 1:5.

In addition to the monomers mentioned above and below, the ethylene vinyl acetate copolymer may contain further comonomers. These monomers are mentioned above and below and reference is made thereto. Especially preferred are vinyl esters and olefins. Suitable vinyl esters derive from fatty acids having linear or branched alkyl groups having 2 to 30 carbon atoms. Examples include vinyl propionate, vinyl butyrate, vinyl hexanoate, vinyl heptanoate, vinyl octanoate, vinyl laurate and vinyl stearate, and also esters of vinyl alcohol based on branched fatty acids, such as vinyl isobutyrate, vinyl pivalate, vinyl 2-ethylhexanoate, vinyl isononanoate, vinyl neononanoate, vinyl neodecanoate and vinyl neoundecanoate. Suitable olefins include propene, butene, isobutylene, hexene, 4-methylpentene, octene, diisobutylene and/or norbornene.

Particularly, ethylene vinyl acetate copolymer may comprise from 0 to 20 weight % and more preferably from 1 to 10 weight % of units being derived from comonomers.

The architecture of the ethylene vinyl acetate copolymers is not critical for many applications and properties. Accordingly, the ester-comprising polymers may be random copolymers, gradient copolymers, block copolymers and/or graft copolymers.

According to a special aspect of the present invention, ethylene vinyl acetate copolymers is a graft copolymer having an ethylene vinyl acetate copolymer as graft base and an alkyl (meth)acrylate having 1 to 30 carbon atoms in the alkyl residue as graft layer. Preferably, the weight ratio of graft base to graft layer is in the range of from 1:1 to 1:20 more preferably 1:2 to 1:10.

The ethylene vinyl acetate copolymers to be used in accordance with the invention preferably have a number average molecular weight $M_n$ in the range of 1000 to 120 000 g/mol, especially in the range of 5000 to 90 000 g/mol and more preferably in the range of 20 000 to 70 000 g/mol.

Particularly, the polydispersity $M_w/M_n$ of the ethylene vinyl acetate copolymers may be in the range from of 1 to 8, preferably from 1.05 to 6.0 and most preferably from 1.2 to 5.0. The weight average molecular weight $M_w$, the number average molecular weight $M_n$ and the polydispersity $M_w/M_n$ can be determined by GPC using a methyl methacrylate polymer as standard.

The ethylene vinyl acetate copolymers to be used in accordance with the invention can be prepared by the free radical polymerization method mentioned above and reference is made thereto. Preferably, the ethylene vinyl acetate copolymers can be manufactured according to the method described in EP-A 406684 filed with the European Patent Office Jun. 27, 1990 under the Application number 90112229.1, to which reference is made explicitly for the purposes of disclosure.

According to a preferred aspect of the present invention, the ethylene vinyl acetate copolymer is a graft copolymer having an ethylene vinyl acetate copolymer as graft base. The ethylene vinyl acetate copolymer useful as graft base preferably have a number average molecular weight $M_n$ in the range of 1000 to 100 000 g/mol, especially in the range of 5000 to 80 000 g/mol and more preferably in the range of 10 000 to 50 000 g/mol.

According to a preferred aspect of the present invention, the composition of the present invention preferably comprises at one polyalkyl(meth)acrylate polymer having a number average molecular weight $M_n$ of from 1000 to 10000 g/mol and a polydispersity $M_w/M_n$ of from 1 to 8. The combination of a polyalkyl(meth)acrylate polymer having the properties mentioned above with an ethylene vinyl acetate copolymer provides a synergistic improvement in oxidation stability and low temperature flow properties of the biodiesel fuel.

Polyalkyl(meth)acrylate polymers are polymers comprising units being derived from alkyl(meth)acrylate monomers. The term (meth)acrylates includes methacrylates and acrylates as well as mixtures thereof. These monomers are well known in the art. The alkyl residue of the ester compounds can be linear, cyclic or branched. Usually, the alkyl residue may comprise 1 to 40, preferably 5 to 30, more preferably 7 to 20 and even more preferably 7 to 15 carbon atoms. The monomers can be used individually or as mixtures of different alkyl(meth)acrylate monomers to obtain the polyalkyl(meth)acrylate polymers useful for the present invention. Usually the polyalkyl(meth)acrylate polymers comprise at least 50% by weight, preferably at least 70% by weight and more preferably at least 90% by weight alkyl(meth)acrylate monomers having 7 to 20, preferably 7 to 15 carbon atoms in the alkyl residue.

According to a preferred aspect of the present invention, the polyalkyl(meth)acrylate polymers useful for the present invention may comprise units being derived from one or more alkyl(meth)acrylate monomers of formula (I)

(I)

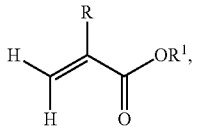

where R is hydrogen or methyl, $R^1$ means a linear, branched or cyclic alkyl residue with 1 to 6 carbon atoms, especially 1 to 5 and preferably 1 to 3 carbon atoms.

Examples of monomers according to formula (I) are, among others, (meth)acrylates which derived from saturated alcohols such as methyl (meth)acrylate, ethyl (meth)acrylate, n-propyl (meth)acrylate, isopropyl (meth)acrylate, n-butyl (meth)acrylate, tert-butyl (meth)acrylate, pentyl (meth)acrylate and hexyl (meth)acrylate; cycloalkyl (meth)acrylates, like cyclopentyl (meth)acrylate and cyclohexyl (meth)acrylate. Preferably, the polymer comprises units being derived from methyl methacrylate.

The polyalkyl(meth)acrylate polymers useful for the present invention may comprise 0 to 40% by weight, preferably 0.1 to 30% by weight, in particular 0.5 to 20% by weight of units derived from one or more alkyl(meth)acrylate monomers of formula (I) based on the total weight of the polymer.

The polyalkyl(meth)acrylate polymer may be obtained preferably by free-radical polymerization. Accordingly the weight fraction of the units of the polyalkyl(meth)acrylate polymer as mentioned in the present application is a result of the weight fractions of corresponding monomers that are used for preparing the inventive polymer.

Preferably, the polyalkyl(meth)acrylate polymer comprises units of one or more alkyl(meth)acrylate monomers of formula (II)

(II)

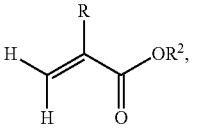

where R is hydrogen or methyl, $R^2$ means a linear, branched or cyclic alkyl residue with 7 to 15 carbon atoms.

Examples of component (II) include (meth)acrylates that derive from saturated alcohols, such as 2-ethylhexyl (meth)acrylate, heptyl (meth)acrylate, 2-tert-butylheptyl (meth)acrylate, n-octyl (meth)acrylate, 3-isopropylheptyl (meth)acrylate, nonyl (meth)acrylate, 2-propylheptyl (meth)acrylate, decyl (meth)acrylate, undecyl (meth)acrylate, 5-methylundecyl (meth)acrylate, n-dodecyl (meth)acrylate, 2-methyldodecyl (meth)acrylate, tridecyl (meth)acrylate, 5-methyltridecyl (meth)acrylate, n-tetradecyl (meth)acrylate, pentadecyl (meth)acrylate;

(meth)acrylates which derive from unsaturated alcohols, for example oleyl (meth)acrylate;

cycloalkyl (meth)acrylates such as cyclohexyl (meth)acrylate having a ring substituent, like tert-butylcyclohexyl (meth)acrylate and trimethylcyclohexyl (meth)acrylate, bornyl (meth)acrylate and isobornyl (meth)acrylate.

The polyalkyl(meth)acrylate polymer preferably comprises at least 10% by weight, especially at least 20% by weight of units derived from one or more alkyl(meth)acrylates of formula (II), based on the total weight of the polymer. According to a preferred aspect of the present invention, the polymer comprises preferably about 25 to 100% by weight, more preferably about 70 to 99% by weight of units derived from monomers according to formula (II).

Furthermore, the polyalkyl(meth)acrylate polymers useful for the present invention may comprise units being derived from one or more alkyl(meth)acrylate monomers of formula (III)

(III)

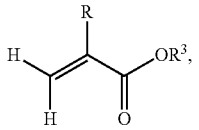

where R is hydrogen or methyl, $R^3$ means a linear, branched or cyclic alkyl residue with 16-40 carbon atoms, preferably 16 to 30 carbon atoms.

Examples of component (III) include (meth)acrylates which derive from saturated alcohols, such as hexadecyl (meth)acrylate, 2-methylhexadecyl (meth)acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyloctadecyl (meth)acrylate, octadecyl (meth)acrylate, nonadecyl (meth)acrylate, eicosyl (meth)acrylate, cetyleicosyl (meth)acrylate, stearyleicosyl (meth)acrylate, docosyl (meth)acrylate and/or eicosyltetratriacontyl (meth)acrylate; cycloalkyl (meth)acrylates such as 2,4,5-tri-t-butyl-3-vinylcyclohexyl (meth)acrylate, 2,3,4,5-tetra-t-butylcyclohexyl (meth)acrylate.

The polyalkyl(meth)acrylate polymers useful for the present invention may comprise 0 to 40% by weight, preferably 0.1 to 30% by weight, in particular 0.5 to 20% by weight of units derived from one or more alkyl(meth)acrylate monomers of formula (III) based on the total weight of the polymer.

According to a special aspect of the present invention, the weight ratio of ester compounds of the formula (II) which contain 7 to 15 carbon atoms in the alcohol radical to the ester compounds of the formula (III) which contain 16 to 40 carbon atoms in the alcohol radical is preferably in the range of 100:1 to 1:1, more preferably in the range of 50:1 to 2:1, especially preferably 10:1 to 5:1.

The ester compounds with a long-chain alcohol residue, especially monomers according to formulae (II) and (III), can be obtained, for example, by reacting (meth)acrylates and/or the corresponding acids with long chain fatty alcohols, where in general a mixture of esters such as (meth)acrylates with different long chain alcohol residues results. These fatty alcohols include, among others, Oxo Alcohol® 7911 and Oxo Alcohol® 7900, Oxo Alcohol® 1100 (Monsanto); Alphanol® 79 (ICI); Nafol® 1620, Alfol® 610 and Alfol® 810 (Sasol); Epal® 610 and Epal® 810 (Ethyl Corporation); Linevol® 79, Linevol® 911 and Dobanol® 25L (Shell AG); Lial 125 (Sasol); Dehydad® and Dehydad® and Lorol® (Cognis).

The polymer may contain units derived from comonomers as an optional component.

These comonomers include hydroxyalkyl (meth)acrylates like 3-hydroxypropyl (meth)acrylate, 3,4-dihydroxybutyl (meth)acrylate, 2-hydroxyethyl (meth)acrylate, 2-hydroxypropyl (meth)acrylate, 2,5-dimethyl-1,6-hexanediol (meth) acrylate, 1,10-decanediol (meth)acrylate;

aminoalkyl (meth)acrylates and aminoalkyl (meth)acrylamides like N-(3-dimethyl-aminopropyl)methacrylamide, 3-diethylaminopentyl (meth)acrylate, 3-dibutyl-aminohexadecyl (meth)acrylate;

nitriles of (meth)acrylic acid and other nitrogen-containing (meth)acrylates like N-(methacryloyloxyethyl)diisobutylketimine, N-(methacryloyloxyethyl)dihexadecylketimine, (meth)acryloylamidoacetonitrile, 2-methacryloyloxyethylmethylcyanamide, cyanomethyl (meth)acrylate;

aryl (meth)acrylates like benzyl (meth)acrylate or phenyl (meth)acrylate, where the acryl residue in each case can be unsubstituted or substituted up to four times;

carbonyl-containing (meth)acrylates like 2-carboxyethyl (meth)acrylate, carboxymethyl (meth)acrylate, oxazolidinylethyl (meth)acrylate, N-methyacryloyloxy)-formamide, acetonyl (meth)acrylate, N-methacryloylmorpholine, N-methacryloyl-2-pyrrolidinone, N-(2-methyacryloxyoxyethyl)-2-pyrrolidinone, N-(3-methacryloyloxy-propyl)-2-pyrrolidinone, N-(2-methyacryloyloxypentadecyl(-2-pyrrolidinone, N-(3-methacryloyloxyheptadecyl-2-pyrrolidinone;

(meth)acrylates of ether alcohols like tetrahydrofurfuryl (meth)acrylate, methoxyethoxyethyl (meth)acrylate, 1-butoxypropyl (meth)acrylate, cyclohexyloxyethyl (meth)acrylate, propoxyethoxyethyl (meth)acrylate, benzyloxyethyl (meth)acrylate, furfuryl (meth)acrylate, 2-butoxyethyl (meth)acrylate, 2-ethoxy-2-ethoxyethyl (meth)acrylate, 2-methoxy-2-ethoxypropyl (meth)acrylate, ethoxylated (meth)acrylates, 1-ethoxybutyl (meth)acrylate, methoxyethyl (meth)acrylate, 2-ethoxy-2-ethoxy-2-ethoxyethyl (meth)acrylate, esters of (meth)acrylic acid and methoxy polyethylene glycols;

(meth)acrylates of halogenated alcohols like 2,3-dibromopropyl (meth)acrylate, 4-bromophenyl (meth)acrylate, 1,3-dichloro-2-propyl (meth)acrylate, 2-bromoethyl (meth) acrylate, 2-iodoethyl (meth)acrylate, chloromethyl (meth) acrylate;

oxiranyl (meth)acrylate like 2,3-epoxybutyl (meth)acrylate, 3,4-epoxybutyl (meth)acrylate, 10,11 epoxyundecyl (meth) acrylate, 2,3-epoxycyclohexyl (meth)acrylate, oxiranyl (meth)acrylates such as 10,11-epoxyhexadecyl (meth)acrylate, glycidyl (meth)acrylate;

phosphorus-, boron- and/or silicon-containing (meth)acrylates like 2-(dimethyl-phosphato)propyl (meth)acrylate, 2-(ethylphosphito)propyl (meth)acrylate, 2-dimethylphosphinomethyl (meth)acrylate, dimethylphosphonoethyl (meth)acrylate, diethylmethacryloyl phosphonate, dipropylmethacryloyl phosphate, 2-(dibutylphosphono)ethyl (meth)acrylate, 2,3-butylenemethacryloylethyl borate, methyldiethoxymethacryloylethoxysiliane, diethylphosphatoethyl (meth)acrylate;

sulfur-containing (meth)acrylates like ethylsulfinylethyl (meth)acrylate, 4-thio-cyanatobutyl (meth)acrylate, ethylsulfonylethyl (meth)acrylate, thiocyanatomethyl (meth)acrylate, methylsulfinylmethyl (meth)acrylate, bis(methacryloyloxyethyl) sulfide;

heterocyclic (meth)acrylates like 2-(1-imidazolyl)ethyl (meth)acrylate, 2-(4-morpholinyl)ethyl (meth)acrylate and 1-(2-methacryloyloxyethyl)-2-pyrrolidone;

maleic acid and maleic acid derivatives such as mono- and diesters of maleic acid, maleic anhydride, methylmaleic anhydride, maleinimide, methylmaleinimide;

fumaric acid and fumaric acid derivatives such as, for example, mono- and diesters of fumaric acid;

vinyl halides such as, for example, vinyl chloride, vinyl fluoride, vinylidene chloride and vinylidene fluoride;

vinyl esters like vinyl acetate;

vinyl monomers containing aromatic groups like styrene, substituted styrenes with an alkyl substituent in the side chain, such as alpha-methylstyrene and alpha-ethylstyrene, substituted styrenes with an alkyl substituent on the ring such as vinyltoluene and p-methylstyrene, halogenated styrenes such as monochlorostyrenes, dichlorostyrenes, tribromostyrenes and tetrabromostyrenes;

heterocyclic vinyl compounds like 2-vinylpyridine, 3-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, 2-methyl-1-vinylimidazole, N-vinylpyrrolidone, 2-vinylpyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles;

vinyl and isoprenyl ethers;

methacrylic acid and acrylic acid.

The comonomers and the ester monomers of the formulae (I), (II) and (III) can each be used individually or as mixtures.

The proportion of comonomers can be varied depending on the use and property profile of the polymer. In general, this proportion may be in the range from 0 to 60% by weight, preferably from 0.01 to 20% by weight and more preferably from 0.1 to 10% by weight. Owing to the combustion properties and for ecological reasons, the proportion of the monomers which comprise aromatic groups, heteroaromatic groups, nitrogen-containing groups, phosphorus-containing groups and sulphur-containing groups should be minimized. The proportion of these monomers can therefore be restricted to 1% by weight, in particular 0.5% by weight and preferably 0.01% by weight.

Preferably, the polyalkyl(meth)acrylate polymer comprises units derived from hydroxyl-containing monomers and/or (meth)acrylates of ether alcohols. According to a preferred aspect of the present invention, the polyalkyl(meth) acrylate polymer preferably comprises 0.1 to 40% by weight, especially 1 to 20% by weight and more preferably 2 to 10% by weight of hydroxyl-containing monomer and/or (meth) acrylates of ether alcohols based on the weight of the polymer. The hydroxyl-containing monomers include hydroxyalkyl (meth)acrylates and vinyl alcohols. These monomers have been disclosed in detail above.

The polyalkyl(meth)acrylate polymers preferably have a number average molecular weight $M_n$ in the range of 1000 to 10 000 g/mol, especially in the range of 2000 to 7000 g/mol and more preferably in the range of 3000 to 6000 g/mol.

The polydispersity $M_w/M_n$ of the polyalkyl(meth)acrylate polymers preferably is in the range from of 1 to 8, especially from 1.05 to 6.0, more preferably from 1.1 to 5.0 and most preferably from 1.3 to 2.5. The weight average molecular weight $M_w$, the number average molecular weight $M_n$ and the polydispersity $M_w/M_n$ can be determined by GPC using a methyl methacrylate polymer as standard.

The architecture of the polyalkyl(meth)acrylate polymers is not critical for many applications and properties. Accordingly, these polymers may be random copolymers, gradient copolymers, block copolymers and/or graft copolymers. Block copolymers and gradient copolymers can be obtained, for example, by altering the monomer composition discontinuously during the chain growth.

The preparation of the polyalkyl(meth)acrylate polymers and the ethylene vinyl acetate copolymer comprising units being derived from at least one alkyl (meth)acrylate from the above-described monomers is known per se. Thus, these polymers can be obtained in particular by free-radical polymerization and related processes, for example ATRP (=Atom Transfer Radical Polymerization), RAFT (=Reversible Addition Fragmentation Chain Transfer) or NMP processes (nitroxide-mediated polymerization). In addition thereto, these polymers are also available by anionic polymerisation.

Customary free-radical polymerization is described, inter alia, in Ullmann's Encyclopedia of Industrial Chemistry, Sixth Edition. In general, a polymerization initiator is used for this purpose. The usable initiators include the azo initiators widely known in the technical field, such as 2,2'-azo-bis-isobutyronitrile (AIBN), 2,2'-azo-bis-(2-methylbutyronitrile) (AMBN) and 1,1-azobiscyclohexanecarbonitrile, and also peroxy compounds such as methyl ethyl ketone peroxide, acetylacetone peroxide, dilauryl peroxide, tert-butyl peroxypivalate, tert-butyl peroxy-2-ethylhexanoate, tert-amyl peroxy-2-ethylhexanoate, ketone peroxide, tert-butyl peroctoate, methyl isobutyl ketone peroxide, cyclohexanone peroxide, dibenzoyl peroxide, tert-butyl-peroxybenzoate, tert-butyl-peroxyisopropylcarbonate, 2,5-bis(2-ethylhexanoyl-peroxy)-2,5-dimethylhexane, tert-butyl-peroxy-2-ethylhexanoate, tert-butyl-peroxy-3,5,5-trimethylhexanoate, dicumyl peroxide, 1,1-bis(tert-butyl-peroxy)cyclohexane, 1,1-bis(tert-butyl-peroxy)-3,3,5-trimethylcyclohexane, cumyl hydroperoxide, tert-butyl-hydroperoxide, bis(4-tert-butylcyclohexyl) peroxydicarbonate, mixtures of two or more of the aforementioned compounds with one another, and mixtures of the aforementioned compounds with compounds which have not been mentioned but can likewise form free radicals. Furthermore a chain transfer agents can be used. Suitable chain transfer agents are in particular oil-soluble mercaptans, for example dodecyl mercaptan or 2-mercaptoethanol, or else chain transfer agents from the class of the terpenes, for example terpineols.

Preferably, the polymers can be achieved by using high amounts of initiator and low amounts of chain transfer agents. Especially, the mixture to obtain the polyalkyl(meth)acrylate polymer useful for the present invention may comprise 1 to 15% by weight, preferably 2 to 10% by weight and more preferable 4 to 8% by weight initiator based on the amount of monomers. The amount of chain transfer agents can be used in an amount of 0 to 2% by weight, preferably 0.01 to 1% by weight and more preferable 0.02 to 0.1% by weight based on the amount of monomers.

The ATRP process is known per se. It is assumed that it is a "living" free-radical polymerization, without any intention that this should restrict the description of the mechanism. In these processes, a transition metal compound is reacted with a compound which has a transferable atom group. This transfers the transferable atom group to the transition metal compound, which oxidizes the metal. This reaction forms a radical which adds onto ethylenic groups. However, the transfer of the atom group to the transition metal compound is reversible, so that the atom group is transferred back to the growing polymer chain, which forms a controlled polymerization system. The structure of the polymer, the molecular weight and the molecular weight distribution can be controlled correspondingly. This reaction is described, for example, by J S. Wang, et al., J. Am. Chem. Soc., vol. 117, p. 5614-5615 (1995), by Matyjaszewski, Macromolecules, vol. 28, p. 7901-7910 (1995). In addition, the patent applications WO 96/30421, WO 97/47661, WO 97/18247, WO 98/40415 and WO 99/10387 disclose variants of the ATRP explained above.

Preferably, catalytic chain transfer processes using cobalt (II) chelates complex can be used to prepare the polymers useful for the present invention as disclosed in U.S. Pat. No. 4,694,054 (Du Pont Co) or U.S. Pat. No. 4,526,945 (SCM Co). The documents U.S. Pat. No. 4,694,054 (Du Pont Co) filed with the United States Patent and Trademark Office Jan. 27, 1986 under the Application number 821,321 and U.S. Pat. No. 4,526,945 (SCM Co) filed with the United States Patent and Trademark Office Mar. 21, 1984 under the Application number 591,804 are enclosed herein by reference.

In addition, the polymers may be obtained, for example, also via RAFT methods. This process is presented in detail, for example, in WO 98/01478 and WO 2004/083169, to which reference is made explicitly for the purposes of disclosure.

In addition, the polymers are also obtainable by NMP processes (nitroxide-mediated polymerization), which is described, inter alia, in U.S. Pat. No. 4,581,429.

These methods are described comprehensively, in particular with further references, inter alia, in K. Matyjazewski, T. P. Davis, Handbook of Radical Polymerization, Wiley Interscience, Hoboken 2002, to which reference is made explicitly for the purposes of disclosure.

The anionic polymerisation is well known in the art and described, inter alia, in Ullmann's Encyclopedia of Industrial Chemistry, Sixth Edition. According to a preferred aspect of the present invention, the polyalkyl(meth)acrylate polymer can be obtained according to a method described in U.S. Pat. No. 4,056,559 (Rohm & Haas Co) filed with the United States Patent and Trademark Office Oct. 23, 1974 under the Application number 517,336. The document U.S. Pat. No. 4,056,559 is enclosed herein by reference. Particularly, potassium methoxide solution can be used as initiator.

The polymerization may be carried out at standard pressure, reduced pressure or elevated pressure. The polymerization temperature too is uncritical. However, it is generally in the range of −200° C. to 200° C., especially 0° C. to 190° C., preferably 60° C. to 180° C. and more preferably 120° C. to 170° C. Higher temperatures are especially preferred in free radical polymerizations using high amounts of initiators.

The polymerization may be carried out with or without solvent. The term solvent is to be understood here in a broad sense.

The polymerization is preferably carried out in a nonpolar solvent. These include hydrocarbon solvents, for example aromatic solvents such as toluene, benzene and xylene, saturated hydrocarbons, for example cyclohexane, heptane, octane, nonane, decane, dodecane, which may also be present in branched form. These solvents may be used individually and as a mixture. Particularly preferred solvents are mineral oils, diesel fuels of mineral origin, naphthenic solvents, natural vegetable and animal oils, biodiesel fuels and synthetic oils (e.g. ester oils such as dinonyl adipate), and also mixtures thereof. Among these, very particular preference is given to mineral oils, mineral diesel fuels and naphthenic solvent (e.g. commercially available Shellsol® A150, Solvesso® A150).

In addition to the ethylene vinyl acetate copolymer comprising units being derived from at least one alkyl (meth) acrylate having 1 to 30 carbon atoms in the alkyl residue as described above, the composition of the present invention may preferably comprise at least one polyalkyl(meth)acrylate polymer. As mentioned above, also the polyalkyl(meth)acrylate polymer may comprise units being derived from ethylene and vinyl acetate as comonomers. However, the ethylene vinyl acetate copolymer differs from the polyalkyl(meth) acrylate copolymer. Especially, the amounts of ethylene and/or vinyl acetate in the ethylene vinyl acetate copolymer are higher than in the polyalkyl(meth)acrylate polymer. Therefore the present composition may preferably comprise at least two polymers being different in their ethylene and/or vinyl acetate proportion.

Preferably, the composition of the present invention may comprise at least one ethylene vinyl acetate copolymer and at least one polyalkyl(meth)acrylate polymer. The weight ratio of both polymers may be in a wide range. Preferably, the weight ratio of the polyalkyl(meth)acrylate polymer having a number average molecular weight $M_n$ of from 1000 to 10000 g/mol and a polydispersity $M_w/M_n$ of from 1 to 8 to the ethylene vinyl acetate copolymer comprising units being derived from at least one alkyl (meth)acrylate having 1 to 30 carbon atoms in the alkyl residue is in the range of from 40:1 to 1:10, particularly 20:1 to 1:2, especially 15:1 to 1:1, more preferably 10:1 to 3:1 and most preferably 6:1 to 5:1.

According to a preferred aspect of the present invention, the composition may comprise a mixture stabilizer, preferably phenolic compounds having exactly one hydroxyl groups such as hydroquinone ethers, sterically hindered phenols, such as 2,4-di-tert-butylhydroxytoluene (BHT), 2,4-dimethyl-6-tert-butylphenol or 2,6-di-tert-butyl-4-methylphenol; and/or tocopherol-compounds, preferably alpha-tocopherol. Preferably sterically hindered phenols, such as 2,4-di-tert-butylhydroxytoluene (BHT), 2,4-dimethyl-6-tert-butylphenol or 2,6-di-tert-butyl-4-methylphenol can be used as mixture stabilizer with 2,4-di-tert-butylhydroxytoluene being more preferred.

Preferably, the composition according to the present invention can be prepared by mixing the components mentioned above. Solvents can be used for accomplishing the mixing. Preferred solvents are polar organic solvents, especially ethers and esters. Preferably, ethers and esters comprise glycol groups.

Preferred solvents include ethers, more preferably glycol ethers such as ethylene glycol monomethyl ether (2-methoxyethanol), ethylene glycol monoethyl ether (2-ethoxyethanol), ethylene glycol monopropyl ether (2-propoxyethanol), ethylene glycol monoisopropyl ether (2-isopropoxyethanol), ethylene glycol monobutyl ether (2-butoxyethanol), ethylene glycol monophenyl ether (2-phenoxyethanol), ethylene glycol monobenzyl ether (2-benzyloxyethanol), diethylene glycol monomethyl ether (2-(2-methoxyethoxy)ethanol), diethylene glycol monoethyl ether (2-(2-ethoxy-ethoxy)ethanol, diethylene glycol mono-n-butyl ether (2-(2-butoxyethoxy) ethanol), ethylene glycol dimethyl ether (dimethoxyethane), ethylene glycol diethyl ether (diethoxyethane) and ethylene glycol dibutyl ether (dibutoxyethane). Regarding the ethers diethylene glycol solvents are preferred, especially diethylene glycol monobutyl ether.

Preferred esters having glycol groups include ethylene glycol methyl ether acetate (2-methoxyethyl acetate), ethylene glycol monethyl ether acetate (2-ethoxyethyl acetate) and ethylene glycol monobutyl ether acetate (2-butoxyethyl acetate).

The mixture achieved can be used as an additive composition.

Preferably, an additive composition comprises at most 70% by weight, especially at most 50% by weight and more preferably at most 30% by weight of solvent. Preferably, an additive composition comprises at least 2% by weight, especially at least 5% by weight and more preferably at least 10% by weight of mixture stabilizer. Preferably, an additive composition comprises at least 2% by weight, especially at least 5% by weight and more preferably at least 10% by weight of mixture antioxidant. Preferably, an additive composition comprises at least 10% by weight, especially at least 20% by weight and more preferably at least 25% by weight of cold flow improver. According to a special aspect of the present invention, the cold flow improver comprises a mixture of more preferably a mixture of at least one polyalkyl(meth) acrylate polymer having a number average molecular weight $M_n$ of from 1000 to 10000 g/mol and a polydispersity $M_w/M_n$ of from 1 to 8 and at least one ethylene vinyl acetate copolymer comprising units being derived from at least one alkyl (meth)acrylate having 1 to 30 carbon atoms in the alkyl residue. The compositions provide homogenous miscible mixture which can improve both cold flow and oxidation stability of fuel/biodiesel.

Preferred additive compositions may comprise (1) 40 to 80%, more preferably 50 to 75% by weight cold flow improver comprising a mixture of more preferably a mixture of at least one polyalkyl(meth)acrylate polymer having a number average molecular weight $M_n$ of from 1000 to 10000 g/mol and a polydispersity $M_w/M_n$ of from 1 to 8 and at least one ethylene vinyl acetate copolymer comprising units being derived from at least one alkyl (meth)acrylate having 1 to 30 carbon atoms in the alkyl residue;

(2) 5 to 30%, more preferably 10 to 20% by weight phenolic compound as antioxidant;

(3) 5 to 30%, more preferably 10 to 20% by weight from glycol ether solvent; and (4) 10-25% mixture stabilizer.

According to a preferred embodiment, the mixture stabilizer and the cold flow improver are mixed as a first solution, while the antioxidant is solved in a solvent to form a second solution. The first and the second solution can be mixed, preferably at a temperature in the range of 40 to 100° C., more preferably at a temperature in the range of 60 to 80° C. to form a homogenous additive mixture which can improve both cold flow and oxidation stability of fuel/biodiesel. The ethylene vinyl acetate copolymer comprising units being derived from at least one alkyl (meth)acrylate having 1 to 30 carbon atoms in the alkyl residue can be added to the first and/or second solution.

Surprisingly an additive composition comprising a mixture of at least one polyalkyl(meth)acrylate polymer having a number average molecular weight $M_n$ of from 1000 to 10000 g/mol and a polydispersity $M_w/M_n$ of from 1 to 8 and at least one ethylene vinyl acetate copolymer comprising units being derived from at least one alkyl (meth)acrylate having 1 to 30 carbon atoms in the alkyl residue provides a stable liquid composition. The stability and miscibility can be improved by using a mixture stabilizer and/or a solvent.

The composition of the present invention is useful for improving the cold flow properties of fuel oil compositions. Usually fuel oil compositions comprise at least 70% by weight, more preferably at least 90% by weight and most preferably at least 98% by weight fuel oil. Useful fuel oils include diesel fuel of mineral origin and biodiesel fuel oil. These fuel oils can be used individually or as mixture.

Preferred fuel oil compositions can comprise (a) 50-100% by weight biodiesel fuel oil, (b) 0-50% by weight diesel fuel of mineral origin, and (c) 0.01-5% by weight additive composition as mentioned above.

The fuel composition of the present invention may comprise diesel fuel of mineral origin, i.e. diesel, gas oil or diesel oil. Mineral diesel fuel is widely known per se and is commercially available. This is understood to mean a mixture of different hydrocarbons which is suitable as a fuel for a diesel engine. Diesel can be obtained as a middle distillate, in particular by distillation of crude oil. The main constituents of the diesel fuel preferably include alkanes, cycloalkanes and aromatic hydrocarbons having about 10 to 22 carbon atoms per molecule.

Preferred diesel fuels of mineral origin boil in the range of 120° C. to 450° C., more preferably 170° C. and 390° C. Preference is given to using those middle distillates which contain 0.2% by weight of sulphur and less, preferably less than 0.05% by weight of sulphur, more preferably less than 350 ppm of sulphur, in particular less than 200 ppm of sulphur and in special cases less than 50 ppm of sulphur, for example less than 10 ppm of sulphur. They are preferably those middle distillates which have been subjected to refining under hydrogenating conditions, and which therefore contain only small proportions of polyaromatic and polar compounds. They are preferably those middle distillates which have 95% distillation points below 370° C., in particular below 350° C. and in special cases below 330° C. Synthetic fuels, as obtainable, for example, by the Fischer-Tropsch process or gas to liquid processes (GTL), are also suitable as diesel fuels of mineral origin.

The kinematic viscosity of diesel fuels of mineral origin to be used with preference is in the range of 0.5 to 8 $mm^2/s$, more preferably 1 to 5 $mm^2/s$, and especially preferably 2 to 4.5 $mm^2/s$ or 1.5 to 3 $mm^2/s$, measured at 40° C. to ASTM D 445.

The fuel compositions of the present invention may comprise at least 20% by weight, in particular at least 30% by weight, preferably at least 50% by weight, more preferably at least 70% by weight and most preferably at least 80% by weight of diesel fuels of mineral origin.

Furthermore, the present fuel composition may comprise at least one biodiesel fuel component. Biodiesel fuel is a substance, especially an oil, which is obtained from vegetable or animal material or both, or a derivative thereof which can be used in principle as a replacement for mineral diesel fuel.

In a preferred embodiment, the biodiesel fuel, which is frequently also referred to as "biodiesel" or "biofuel" comprises fatty acid alkyl esters formed from fatty acids having preferably 6 to 30, more preferably 12 to 24 carbon atoms, and monohydric alcohols having 1 to 4 carbon atoms. In many cases, some of the fatty acids may contain one, two or three double bonds. The monohydric alcohols include in particular methanol, ethanol, propanol and butanol, methanol being preferred.

Examples of oils which derive from animal or vegetable material and which can be used in accordance with the invention are palm oil, rapeseed oil, coriander oil, soya oil, cottonseed oil, sunflower oil, castor oil, olive oil, groundnut oil, corn oil, almond oil, palm kernel oil, coconut oil, mustard seed oil, oils which are derived from animal tallow, especially beef tallow, bone oil, fish oils and used cooking oils. Further examples include oils which derive from cereal, wheat, jute, sesame, rice husks, jatropha, arachis oil and linseed oil. The fatty acid alkyl esters to be used with preference may be obtained from these oils by processes known in the prior art.

Preference is given in accordance with the invention to highly C16:0/C18:0-glyceride-containing oils, such as palm oils and oils which are derived from animal tallow, and also derivatives thereof, especially the palm oil alkyl esters which are derived from monohydric alcohols. Palm oil (also: palm fat) is obtained from the fruit flesh of the palm fruits. The fruits are sterilized and pressed. Owing to their high carotene content, fruits and oils have an orange-red colour which is removed in the refining. The oil may contain up to 80% C18:0-glyceride.

Particularly suitable biodiesel fuels are lower alkyl esters of fatty acids. Useful examples here are commercial mixtures of the ethyl, propyl, butyl and especially methyl esters of fatty acids having 6 to 30, preferably 12 to 24, more preferably 14 to 22 carbon atoms, for example of caprylic acid, capric acid, lauric acid, myristic acid, palmitic acid, margaric acid, stearic acid, arachic acid, behenic acid, lignoceric acid, cerotic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid.

In a particular aspect of the present invention, a biodiesel fuel is used which comprises preferably at least 10% by weight, more preferably at least 30% by weight and most preferably at least 40% by weight of saturated fatty acid esters which are derived from methanol and/or ethanol. Especially, these esters have at least 16 carbon atoms in the fatty acid radical. These include in particular the esters of palmitic acid and stearic acid.

For reasons of cost, these fatty acid esters are generally used as a mixture. Biodiesel fuels usable in accordance with the invention preferably have an iodine number of at most 150, in particular at most 125, more preferably at most 70 and most preferably at most 60. The iodine number is a measure known per se for the content in a fat or oil of unsaturated compounds, which can be determined to DIN 53241-1. As a result of this, the fuel compositions of the present invention form a particularly low level of deposits in the diesel engines. Moreover, these fuel compositions have particularly high cetane numbers.

In general, the fuel compositions of the present invention may comprise at least 0.5% by weight, in particular at least 3% by weight, preferably at least 5% by weight and more preferably at least 15% by weight of biodiesel fuel. According to a further aspect of the present invention, the fuel compositions of the present invention may comprise at least 80% by weight, more preferably at least 95% by weight of biodiesel fuel.

Preferably, the total amount of at least one polyalkyl(meth) acrylate polymer having a number average molecular weight $M_n$ of from 1000 to 10000 g/mol and a polydispersity $M_w/M_n$ of from 1 to 8 and at least one ethylene vinyl acetate copolymer comprising units being derived from at least one alkyl (meth)acrylate having 1 to 30 carbon atoms in the alkyl residue comprises 0.01 to 5% by weight, especially 0.05 to 1% by weight, preferably 0.1 to 0.5 and more preferably 0.2 to 0.4% by weight of the fuel composition of the present invention.

In yet another embodiment the concentration of each antioxidant in the biodiesel fuel is from about 20 to about 5000 ppm, or from about 50 to about 5000, or from about 50 to about 2000, or from about 200 to about 2000 or from about 200 to about 1000 or from about 500 to about 1000 or from about 300 to about 700. In certain embodiments the total concentration of antioxidants in the biofuel is about 20 to about 5000 ppm, preferably 200 to about 2000 ppm. In a particular embodiment the biodiesel fuel comprises tert-butylhydroquinone (TBHQ) at a concentration of about 250 to 1000 ppm and propyl gallate and/or pyrogallol at a concentration of about 50 to 500 ppm.

The inventive fuel composition may comprise further additives in order to achieve specific solutions to problems. These additives include dispersants, for example wax dispersants and dispersants for polar substances, demulsifiers, defoamers, lubricity additives, additional antioxidants, cetane number improvers, detergents, dyes, corrosion inhibitors, metal deactivators, metal passivators and/or odourants. E.g. the composition may comprise ethylene vinyl acetate (EVA) having no units being derived from alkyl (meth)acrylate having 1 to 30 carbon atoms in the alkyl residue as mentioned in the documents above.

By virtue of a fuel composition containing at least 20% by weight of diesel fuel of mineral origin, at least 3% by weight biodiesel fuel and from 0.05 to 5% by weight of an additive composition, it is surprisingly possible to provide a fuel composition which, with a property profile which is very similar to that of mineral diesel fuel, comprises a very high proportion of renewable raw materials.

These compositions comprising at least 20% by weight of diesel fuel of mineral origin and at least 3% by weight biodiesel fuel can be used in conventional diesel engines without the seal materials used customarily being attacked.

Furthermore, modern diesel engines can be operated with the fuel of the present invention without the engine control having to be altered.

Preferred fuel compositions consist of 20.0 to 97.95% by weight, in particular 70 to 94.95% by weight, of mineral diesel fuel, 2.0 to 79.95% by weight, in particular 5.0 to 29.95% by weight, of biodiesel fuel, 0.05 to 5% by weight, in particular 0.1 to 1% by weight, of cold flow improver, preferably ethylene vinyl acetate copolymer comprising units being derived from at least one alkyl (meth)acrylate having 1 to 30 carbon atoms in the alkyl residue and if present polyalkyl(meth)acrylate polymer, 0.001 to 1% by weight, especially 0.01 to 0.5% by weight, more preferably 0.02 to 0.3% by weight and most preferably 0.1 to 0.2% by weight antioxidant, and 0 to 60% by weight, in particular 0.1 to 10% by weight, of additives.

According to a further aspect of the present invention, a fuel oil composition may comprise at least 30%, especially at least 40%, and more preferably at least 50% by weight biodiesel fuel. Such composition provides a high ecological quality.

Preferred fuel compositions according to that aspect of the present invention consist of 20.0 to 97.95% by weight, in particular 70 to 94.95% by weight, of biodiesel diesel fuel, 0.0 to 79.95% by weight, in particular 5.0 to 29.95% by weight, of mineral fuel, 0.05 to 5% by weight, in particular 0.1 to 1% by weight, of cold flow improver, preferably ethylene vinyl acetate copolymer comprising units being derived from at least one alkyl (meth)acrylate having 1 to 30 carbon atoms in the alkyl residue and if present polyalkyl(meth)acrylate polymer, 0.001 to 1% by weight, especially 0.01 to 0.5% by weight more preferably 0.02 to 0.3% by weight and most preferably 0.1 to 0.2% by weight antioxidant, and 0 to 60% by weight, in particular 0.02 to 10% by weight, of additives.

The inventive fuel compositions preferably have an iodine number of at most 30, more preferably at most 20 and most preferably at most 10.

In addition, the inventive fuel compositions have outstanding low-temperature properties. In particular, the pour point (PP) to ASTM D97 preferably has values of less than or equal to 0° C., preferably less than or equal to −5.0° C. and more preferably less than or equal to −10.0° C. The limit of filterability (cold filter plugging point, CFPP) measured to DIN EN 116 is preferably at most 0° C., more preferably at most −5° C. and more preferably at most −10° C. Moreover, the cloud point (CP) to ASTM D2500 of preferred fuel compositions may assume values of less than or equal to 0° C., preferably less than or equal to −5° C. and more preferably less than or equal to −10° C.

In addition, the inventive fuel compositions have also outstanding oxidation stability. In particular, the Rancimat induction period measured to EN 14112 at 110° C. preferably has values of more than or equal to 5.0 h, preferably more than or equal to 6.0 h and more preferably more than or equal to 7.0 h. The improvement in oxidation stability can comprise at least an increase in Rancimat induction period measured to EN 14112 at 110° C. preferably has values of more than or equal to 3.0 h, preferably more than or equal to 5.0 h and more preferably more than or equal to 6.0 h based on the fuel composition without the inventive additive.

The cetane number to DIN 51773 of inventive fuel compositions is preferably at least 50, more preferably at least 53, in particular at least 55 and most preferably at least 58.

The viscosity of the present fuel compositions may be within a wide range, and this feature can be adjusted to the intended use. This adjustment can be effected, for example, by selecting the biodiesel fuels or the mineral diesel fuels. In addition, the viscosity can be varied by the amount and the molecular weight of the ester-comprising polymers used. The kinematic viscosity of preferred fuel compositions of the present invention is in the range of 1 to 10 $mm^2/s$, more preferably 2 to 5 $mm^2/s$ and especially preferably 2.5 to 4.5 $mm^2/s$, measured at 40° C. to ASTM D445.

The use of antioxidants and ethylene vinyl acetate copolymer comprising units being derived from at least one alkyl (meth)acrylate having 1 to 30 carbon atoms in the alkyl residue in a concentration of 0.05 to 5% by weight as a flow improver in fuel compositions which comprise diesel fuel of mineral origin and/or biodiesel fuel accordingly provides fuel compositions with exceptional properties, especially a high oxidation stability and good cold flow properties.

The invention will be illustrated in detail hereinafter with reference to examples and comparative examples, without any intention that this should impose a restriction. Unless otherwise specified, the percentages are weight percent.

Preparation of PAMA-1

The PAMA oligomer, which has number-based molecular weight, $M_n$, in the range of 1,000-10,000 Da (which correspond to approximately 5 to 50 repeating units), have been prepared via the following method.

14.9 gram of solvent naphta heavy (e.g. Shellsol® or Solvesso® A150) was loaded in a 500 mL 4-neck reactor under dry nitrogen and stirred at 140° C. A monomer mixture containing 75.7 gram dodecyl pentadecyl methacrylate (DPMA), 0.8 gram methyl methacrylate (MMA), 0.02 gram n-dodecyl mercaptane and 8.4 gram 2,2-bis(tert-butylperoxy) butane had been prepared. The monomer mixture was fed at 140° C. for 5 hours to the reactor containing solvent. The reaction was held for another 120 minutes at 140° C. The mixture was cooled down to 100° C. Thereafter, 0.15 gram of t-butylperoxy-2-ethyl-hexanoate was added. The reaction mixture was stirred for another 90 minutes at 100° C.

The molecular weight was analyzed via gel permeation chromatography (GPC). The number average molecular weight was $M_n$=3,740 Da; the weight average molecular weight was $M_w$=5,760 Da and polydispersity index was PDI ($M_w/M_n$)=1.54. In the following, the polymer obtained is called PAMA-1.

Preparation of EVA-1

Preparation of EVA-Graft-PA(M)A as Disclosed in U.S. Pat. No. 4,906,682 (Röhm GmbH).

20 gram of EVA copolymer comprising about 33%-weight vinyl acetate and a number average molecular weight of $M_n$=36,400 Da (commercially available under trade name Evatane 33-25 from Arkema Inc) have been solved in 150 gram dilution oil by stirring the mixture at 100° C. overnight. The temperature was adjusted to 90° C. Thereafter 80 gram of dodecyl pentadecyl methacrylate (DPMA) containing 0.5% tert-butylperoxy-2-ethyl-hexanoate have been added to the EVA copolymer solution over 3.5 hours. The reaction was maintained by stirring the mixture at 90° C. for another 2 hours. Then 0.2% tert-butylperoxy-2-ethyl-hexanoate was added and the mixture was hold for another 45 minutes.

The number average molecular weight was $M_n$=51,170 Da; the weight average molecular weight was $M_n$=109,340 Da and polydispersity index was PDI ($M_w/M_n$)=2.14. In the following the polymer obtained is called EVA-1.

Preparation of a Mixture Comprising PAMA-1 and EVA-1

85 gram of PAMA-1 and 15 gram of EVA-1 have been blended by stirring at 60-80° C. for minimum 1 hour. A colorless stable mixture had been achieved. The mixture obtained is called CFI-1.

EXAMPLES 1 TO 6 AND COMPARATIVE EXAMPLES 1 TO 3

The polymers obtained according to the Preparation Examples mentioned above had been used to prepare compositions of the present invention.

In a 50 mL reaction flask, 15 grams of tert-butylhydroquinone (TBHQ) in 15 gram of diethylene glycol monobutyl ether at 60° C. have been dissolved under nitrogen inert for minimum one hour. The solution is called Solution I.

In 150 mL flask, 50 gram of CFI-1 and 20 gram of 2,4-di-tert-butylhydroxytoluene (BHT) have been blended under inert nitrogen at 60° C. for minimum one hour. The mixture is called Solution II.

Afterwards, Solution I and Solution II have been mixed at 60° C. under inert nitrogen for one hour. The final mixture obtained contains 50% CFI-1, 15% TBHQ, 15% diethylene glycol monobutyl ether and 20% BHT, and is called Additive A1.

The following Examples and Comparative Examples were all prepared in the similar manner with the preparation of Additive A1, but with different composition in Solution I and Solution II as described in Table 1.

TABLE 1

| Additive | Solution I | | Solution II | |
|---|---|---|---|---|
| | Antioxidant | Solvent | CFI | Mixture stabilizer |
| A1 | 15% TBHQ | 15% diethylene glycol monobutyl ether | 50% CFI-1 | 20% BHT |
| A2 | 25% TBHQ | 25% diethylene glycol monobutyl ether | 50% CFI-1 | none |
| A3 | 15% TBHQ | 15% rapeseed oil biodiesel | 50% CFI-1 | 20% BHT |

TABLE 1-continued

| Additive | Solution I | | Solution II | |
|---|---|---|---|---|
| | Antioxidant | Solvent | CFI | Mixture stabilizer |
| A4 | 15% TBHQ | 15% diisononyl adipate | 50% CFI-1 | 20% BHT |
| B1 | 15% TBHQ | 15% diethylene glycol monobutyl ether 50% solvent naphtha 150 | none | 20% BHT |
| B2 | 15% TBHQ | 15% diethylene glycol monobutyl ether | 50% PAMA-1 | 20% BHT |
| B3 | 15% TBHQ | 15% diethylene glycol monobutyl ether | 42.5% PAMA-1 7.5% EVA 33-025 | 20% BHT |
| A5 | 4% TBHQ 0.8% pyrogallol | none | 71.2% CFI-1 | 24% BHT |
| A6 | 15% TBHQ 5% pyrogallol | 15% diethylene glycol monobutyl ether | 50% CFI-1 | 15% BHT |

Table 2 describes the improvement of the cold flow properties and oxidation stability of RME using the polymers described above. For the following tests rapeseed oil methyl ester (RME) with CFPP=−14° C. and Rancimat Induction Period (IP) of 2.2-3.0 hours was used as fuel oil. The cold flow properties of the fuel oils comprising different amounts of additives had been determined according to the cold filter plugging point (CFPP) test (ASTM D6371). The oxidation stability had been determined according to the Rancimat test (EN 14112) measured at 110° C. In this test, a purified air stream is fed through the sample to induce the formation of volatile acids formed from the oxidation process. These volatile acids are then distilled into a measurement vessel containing deionised water, in which the conductivity of the solution is measured. The end of induction period is measured as the conductivity increases.

TABLE 2

| Additive | treat rate (ppm) | CFPP (° C.) | IP (hours) | delta IP (hours) |
|---|---|---|---|---|
| A1 | 0 | −14 | 3.0 | 0.0 |
| | 1000 | −17 | 5.6 | 2.6 |
| | 2000 | −20 | 7.8 | 4.8 |
| | 3000 | −21 | 9.9 | 6.9 |
| A2 | 0 | −14 | 2.9 | 0.0 |
| | 1000 | −15 | 6.0 | 3.1 |
| | 2000 | −20 | 9.1 | 6.2 |
| | 3000 | −22 | 11.8 | 8.9 |
| A3 | 0 | −14 | 2.9 | 0.0 |
| | 1000 | −17 | 5.5 | 2.6 |
| | 2000 | −21 | 8.1 | 5.2 |
| | 3000 | −22 | 9.9 | 7.0 |
| A4 | 0 | −14 | 2.9 | 0.0 |
| | 1000 | −17 | 5.5 | 2.6 |
| | 2000 | −21 | 7.7 | 4.8 |
| | 3000 | −22 | 9.7 | 6.8 |
| B1 | 0 | −14 | 2.5 | 0.0 |
| | 1000 | −15 | 4.7 | 2.2 |
| | 2000 | −15 | 7.0 | 4.5 |
| | 3000 | −15 | 8.9 | 6.4 |
| B2 | 0 | −14 | 2.2 | 0.0 |
| | 1000 | −19 | 4.1 | 1.9 |
| | 2000 | −19 | 5.9 | 3.7 |
| | 3000 | −19 | 7.2 | 5.0 |

TABLE 2-continued

| Additive | treat rate (ppm) | CFPP (° C.) | IP (hours) | delta IP (hours) |
|---|---|---|---|---|
| B3 | 0 | −14 | 2.2 | 0.0 |
| | 1000 | −17 | 3.9 | 1.7 |
| | 2000 | −20 | 5.7 | 3.5 |
| | 3000 | −20 | 7.5 | 5.3 |
| A5 | 0 | −14 | 2.4 | 0.0 |
| | 1000 | −19 | 3.9 | 1.5 |
| | 2000 | −21 | 5.2 | 2.8 |
| | 3000 | −22 | 6.2 | 3.8 |
| A6 | 0 | −14 | 2.4 | 0.0 |
| | 1000 | −17 | 5.1 | 2.7 |
| | 2000 | −20 | 7.6 | 5.2 |
| | 3000 | −20 | 10.4 | 8.0 |

The results clearly showed an obvious advantage of using the new cold flow improvers. The new composition provides a very low cold filter plugging point. In addition thereto, the compositions of the present invention show good oxidation stability. In particular, due to the presence of the grafted-EVA component in this new composition, synergistic effect in both cold filter plugging point and oxidation stability can be obtained (as clearly shown by comparing data obtained by A1 versus B2 and B3).

Surprisingly, the compositions A1 and A6 form a miscible stable solution. The composition A5 shows some tendencies to form crystals after 5 days. In the absence of the grafted-EVA component, the composition B2 forms an immiscible two-phase mixture.

The invention claimed is:

1. An additive composition, comprising:

(a) at least 2% by weight of tert-butylhydroquinone, (b) at least 2% by weight of 2,4-di-tert-butylhydroxytoluene, (c) at least 10% by weight of a cold flow improver comprising at least one polyalkyl(meth)acrylate polymer having a number average molecular weight Mn of from 1000 to 10000 g/mol and a polydispersity Mw/Mn of from 1 to 8, and at least one ethylene vinyl acetate graft copolymer having an ethylene vinyl acetate copolymer as graft base and an alkyl (meth)acrylate having 1 to 30 carbon atoms in an alkyl residue as graft layer, wherein the weight ratio of said polyalkyl(meth)acrylate polymer to said ethylene vinyl acetate graft copolymer is in the range of from 15:1 to 1:1.

2. The additive composition according to claim 1, wherein said ethylene vinyl acetate graft copolymer comprises from 2 to 36 weight % of vinyl acetate.

3. The additive composition according to claim 1, wherein the ethylene vinyl acetate graft copolymer comprises from 30 to 80 weight % of units obtained from at least one alkyl (meth)acrylate having 1 to 30 carbon atoms in the alkyl residue.

4. The additive composition according to claim 1, wherein the ethylene vinyl acetate graft copolymer comprises from 5 to 40 weight % of units obtained from ethylene.

5. The additive composition according to claim 1, wherein the ethylene vinyl acetate graft copolymer comprises from 30 to 90 weight % of units obtained from at least one alkyl (meth)acrylate having 7 to 20 carbon atoms in the alkyl residue.

6. The additive composition according to claim 1, wherein a weight ratio of the graft base to the graft layer is of from 1:1 to 1:20.

7. The additive composition according to claim 1, wherein the polyalkyl(meth)acrylate polymer comprises at least 50% by weight of units obtained from at least one alkyl (meth)acrylate having 7 to 20 carbon atoms in the alkyl residue.

8. The additive composition according to claim 1, wherein the polydispersity $M_w/M_n$ of the polyalkyl(meth)acrylate polymer is of from 1.1 to 5.

9. The additive composition according to claim 1, wherein a weight ratio of the hydroquinone compound to the ethylene vinyl acetate graft copolymer is of from 5:1 to 1:5.

10. The additive composition according to claim 1, further comprising:

an ether compound as solvent.

11. The additive composition according to claim 10, wherein the ether compound is glycol ether.

12. A fuel oil composition, comprising:

at least 80% by weight of a biodiesel fuel oil; and said additive composition according to claim 1.

13. The fuel oil composition according to claim 12, wherein said biodiesel comprises at least 10% by weight of a fatty acid ester which is obtained from methanol and/or ethanol and a saturated fatty acid.

14. The fuel oil composition according to claim 12, further comprising diesel fuel of mineral origin.

15. The fuel oil composition according to claim 12, wherein further comprising:

at least one additive selected from the group consisting of dispersants, demulsifiers, defoamers, lubricity additives, additional antioxidants, cetane number improvers, detergents, dyes, corrosion inhibitors, metal deactivators, metal passivators and odourants.

* * * * *